US011847978B2

(12) United States Patent
Lim et al.

(10) Patent No.: US 11,847,978 B2
(45) Date of Patent: Dec. 19, 2023

(54) DISPLAY DEVICE HAVING A LUMINANCE COMPENSATOR BASED ON SENSING CURRENT FROM A DISPLAY PANEL

(71) Applicant: Samsung Display Co., LTD., Yongin-si (KR)

(72) Inventors: Namjae Lim, Yongin-si (KR); Sungjae Park, Seongnam-si (KR); Seungho Park, Suwon-si (KR); Seunghwan Park, Anyang-si (KR); Jaehoon Lee, Seoul (KR); Jinho Lee, Hwaseong-si (KR); Youngwoon Choi, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/882,612

(22) Filed: Aug. 8, 2022

(65) Prior Publication Data

US 2023/0040791 A1 Feb. 9, 2023

(30) Foreign Application Priority Data

Aug. 9, 2021 (KR) ..... 10-2021-0104742

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0842* (2013.01); *G09G 2310/0272* (2013.01); *G09G 2310/0278* (2013.01); *G09G 2320/0233* (2013.01)

(58) Field of Classification Search
CPC ..... G09G 3/3291
USPC ..... 345/204
See application file for complete search history.

(56) References Cited

U.S. PATENT DOCUMENTS

2020/0271993 A1 8/2020 Lim et al.
2020/0365091 A1* 11/2020 Pyun ..... G09G 3/3283
2021/0012704 A1* 1/2021 Pyun ..... G09G 3/32

FOREIGN PATENT DOCUMENTS

KR 10-2020-0102616 9/2020

* cited by examiner

*Primary Examiner* — Long D Pham
(74) *Attorney, Agent, or Firm* — H.C. Park & Associates, PLC

(57) ABSTRACT

A display device includes a display panel, a luminance compensator, and a data driver. The display panel includes a plurality of pixels. The luminance compensator is configured to calculate a scaling factor based on a target current, a black image current, and a sensing current. The target current is calculated based on an input current input to the display panel. The sensing current is measured from the display panel. The data driver is configured to generate a data voltage based on input image data to supply the data voltage to the pixels. The data voltage has a voltage level adjusted based on the scaling factor.

20 Claims, 10 Drawing Sheets

DISPLAY DEVICE HAVING A LUMINANCE COMPENSATOR BASED ON SENSING CURRENT FROM A DISPLAY PANEL

CROSS REFERENCE TO RELATED APPLICATION

This application claims priority from and the benefit of Korean Patent Application No. 10-2021-0104742, filed on Aug. 9, 2021, which is hereby incorporated by reference for all purposes as if fully set forth herein.

BACKGROUND

Field

Embodiments of the invention relate generally to a display device and a method of driving a display device and more specifically, to a display device including a luminance compensator and a method of driving a display device including a luminance compensator.

Discussion of the Background

Flat panel display devices are used as display devices for replacing a cathode ray tube display device due to lightweight and thin characteristics thereof. As representative examples of such flat panel display devices, there are a liquid crystal display device, an organic light emitting diode display device, a quantum dot display device, and the like.

The organic light emitting diode display device or the quantum dot display device may include a display panel, a data driver, a scan driver, a luminance compensator, a controller, and the like. The display panel may include scan lines, data lines, and pixels (e.g., a transistor, a light emitting element, etc.) connected to the lines. The scan driver may provide scan signals to the pixels through the scan lines, and the data driver may provide data voltages to the pixels through the data lines. The controller may control the scan driver and the data driver. In this case, a luminance of an image displayed on the display panel may be non-uniform because of a variation of a threshold voltage of a driving transistor included in the display panel, a variation of a capacitance of a capacitor, a leakage current in the display panel, a temperature variation caused by heat generated by the pixels or the lines, deterioration of the pixels, and the like.

The above information disclosed in this Background section is only for understanding of the background of the inventive concepts, and, therefore, it may contain information that does not constitute prior art.

SUMMARY

Display devices and methods of driving the display devices according to the principles of the invention are capable of improving image quality of the display devices by performing luminance compensation on image data based on a black image current, which is measured when a black image is displayed.

Additional features of the inventive concepts will be set forth in the description which follows, and in part will be apparent from the description, or may be learned by practice of the inventive concepts.

According to an aspect of the invention, a display device includes a display panel, a luminance compensator, and a data driver. The display panel includes a plurality of pixels.

The luminance compensator is configured to calculate a scaling factor based on a target current, a black image current, and a sensing current. The target current is calculated based on an input current input to the display panel. The sensing current is measured from the display panel. The data driver is configured to generate a data voltage based on input image data to supply the data voltage. The data voltage has a voltage level adjusted based on the scaling factor, to the pixels.

The luminance compensator may include a black image current generator, a current sensor, and a memory. The black image current generator may be configured to measure the black image current from the display panel by the current sensor under a preset condition, and may store the measured black image current in the memory.

The luminance compensator may be configured to calculate a sub-scaling factor based on the measured black image current.

The data driver may be configured to supply a sub-data voltage to the pixels. The sub-data voltage has a voltage level adjusted based on the sub-scaling factor.

The measured black image current may include a current measured from the display panel when a black image is displayed on the display panel.

The black image current generator may be configured to measure the black image current from the display panel by the current sensor when a maximum data value is zero grayscale level or an input load value is zero within one frame.

The black image current generator may be configured to measure the black image current from the display panel by the current sensor when a maximum data value is zero grayscale level within one frame, and the maximum data value may be maintained to have zero grayscale level for a preset number of frames or more.

The display device may further include a temperature sensor connected to the black image current generator, and may be configured to measure a temperature of the display panel.

The black image current generator may be configured to measure the black image current from the display panel by the current sensor when a maximum data value is zero grayscale level within one frame. The temperature measured from the display panel by the temperature sensor may be less than or equal to a preset temperature. The maximum data value may be maintained to have zero grayscale level for a preset number of frames or more.

The display device may further include a scan driver configured to generate a scan signal to supply the scan signal to the pixels and a controller configured to generate the input image data to provide the input image data to the data driver.

According to another aspect of the invention, a display device includes a display panel, a luminance compensator, and a data driver. The display panel includes a plurality of pixels. The luminance compensator includes a black image current generator, a current sensor, and a memory. The luminance compensator is configured to measure a black image current from the display panel by the current sensor under a preset condition by the black image current generator, store the measured black image current in the memory, and calculate a sub-scaling factor based on a target current, the measured black image current, and a sensing current, the target current calculated based on an input current input to the display panel, the sensing current measured from the display panel. The data driver is configured to generate a sub-data voltage based on input image data to supply the sub-data voltage to the pixels. The sub-data voltage has a voltage level adjusted based on the sub-scaling factor.

The measured black image current may include a current measured from the display panel when a black image is displayed on the display panel.

The black image current generator may be configured to measure the black image current from the display panel by the current sensor when a maximum data value is zero grayscale level within one frame.

The black image current generator may be configured to measure the black image current from the display panel by the current sensor when a maximum data value is zero grayscale level within one frame, and the maximum data value may be maintained to have zero grayscale level or an input load value is zero for a preset number of frames or more.

The display device may further include a temperature sensor connected to the black image current generator. The temperature sensor may be configured to measure a temperature of the display panel. The black image current generator may be configured to measure the black image current from the display panel by the current sensor when a maximum data value is zero grayscale level within one frame. The temperature measured from the display panel by the temperature sensor may be less than or equal to a preset temperature, and the maximum data value may be maintained to have zero grayscale level for a preset number of frames or more.

According to another aspect of the invention, a method of driving a display device is provided as follows. An input current input to a display panel is sensed. A target current based on the input current and a black image current is calculated. A sensing current is measured from the display panel. A scaling factor for controlling a voltage level of a data voltage corresponding to input image data based on the sensing current and the target current is calculated. A data voltage, which has a voltage level adjusted based on the scaling factor, is supplied to pixels.

The method may further include determining whether a maximum data value is zero grayscale level within one frame, measuring the black image current when the maximum data value is determined as zero grayscale level or the input load value is determined as zero, and storing the measured black image current in a memory of a luminance compensator.

The method may further include determining whether a maximum data value is maintained to have zero grayscale level for a preset number of frames or more, measuring the black image current when the maximum data value is determined as being maintained to have zero grayscale level for the preset number of frames or more, and storing the measured black image current in a memory of a luminance compensator.

The method may further include determining whether a temperature measured from the display panel is less than or equal to a preset temperature, measuring the black image current when the temperature measured from the display panel is determined as being less than or equal to the preset temperature, and storing the measured black image current in a memory of a luminance compensator.

The method may further include sensing the input current input to the display panel, calculating a sub-target current based on the input current and the measured black image current, measuring the sensing current from the display panel, calculating a sub-scaling factor for controlling the voltage level of the data voltage corresponding to the input image data based on the sensing current and the sub-target current, and supplying a sub-data voltage, which has a voltage level adjusted based on the sub-scaling factor, to the pixels.

Since the display device according to the embodiments is configured such that the target current is determined by adding the input current input to the display panel to the black image current, and the current corresponding to the difference between the target current and the sensing current is determined as the scaling factor, display quality of the display device may be relatively improved.

In addition, since the luminance compensator includes the measured black image current, even when the black image current varies, the sub-scaling factor may be prevented from being excessively corrected, especially at the low grayscale level. Accordingly, the luminance compensator may generate the sub-target current that is relatively accurate even at the low grayscale level, and the data driver may provide the sub-data voltage that is accurate to the pixel based on the sub-target current and the sensing current.

Since the method of driving the display device according to embodiments is configured such that the target current is determined by adding the input current input to the display panel to the black image current, and the current corresponding to the difference between the target current and the sensing current is determined as the scaling factor, display quality of the display device may be relatively improved.

In addition, since the luminance compensator includes the measured black image current, even when the black image current varies, the sub-scaling factor may be prevented from being excessively corrected, especially at a low grayscale level. Accordingly, the luminance compensator may generate the sub-target current that is relatively accurate even at the low grayscale level, and the data driver may provide the sub-data voltage that is accurate to the pixel based on the sub-target current and the sensing current.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
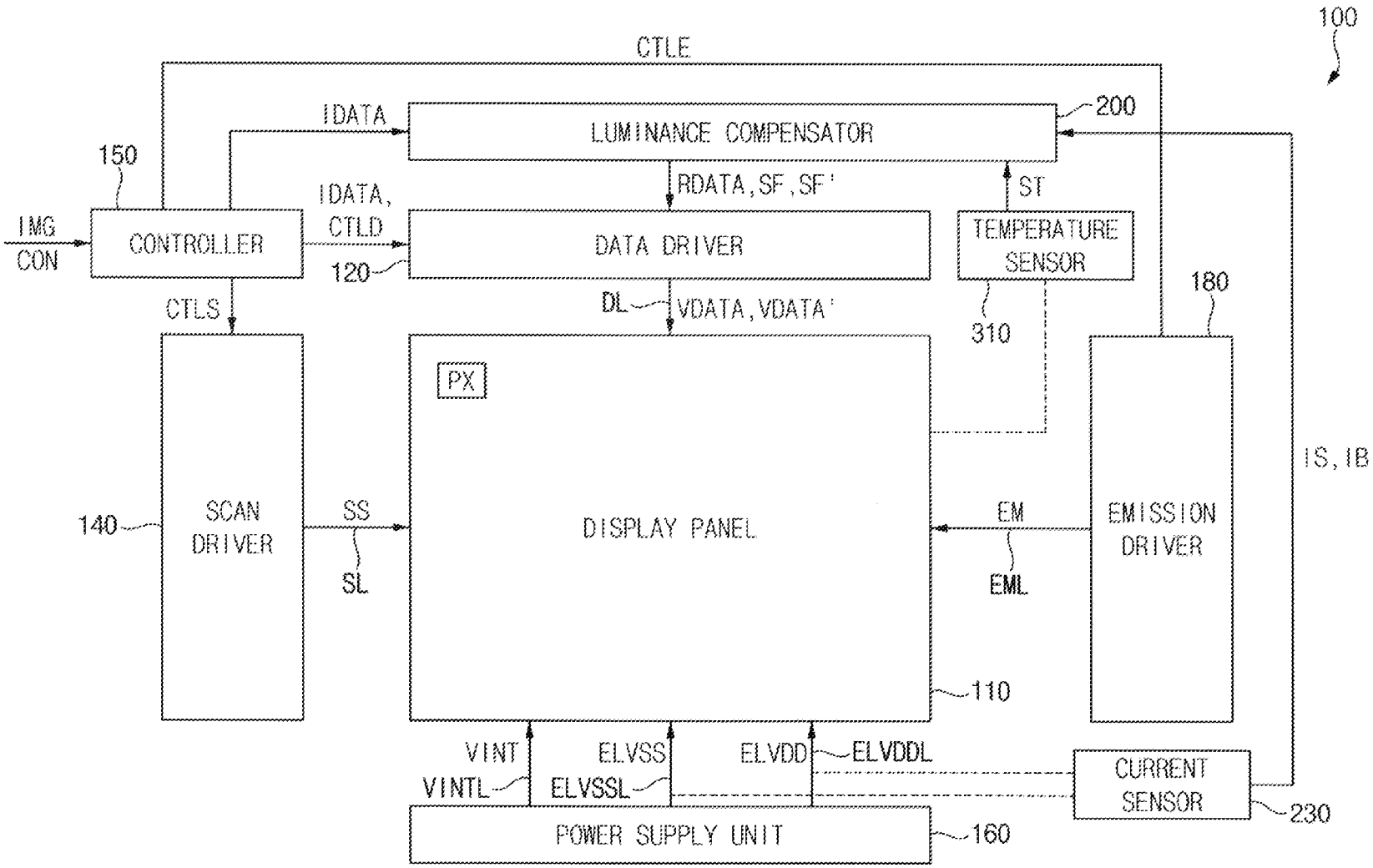
FIG. 1 is a block diagram of an embodiment of a display device constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, a display device and a method of driving display device according to embodiments will be described in detail with reference to the accompanying drawings. In the accompanying drawings, same or similar reference numerals refer to the same or similar elements.

FIG. 1 is a block diagram showing a display device according to embodiments.

Referring to FIG. 1, a display device 100 may include a display panel 110 including a plurality of pixels PX, a controller 150, a data driver 120, a scan driver 140, an emission driver 180, a power supply unit 160, a luminance compensator 200, a current sensor 230, a temperature sensor 310, and the like.

The display panel 110 may include a plurality of data lines DL, a plurality of scan lines SL, a plurality of emission lines EML, a plurality of first power supply voltage lines ELVDDL, a plurality of second power supply voltage lines ELVSSL, a plurality of initialization voltage lines VINTL, and a plurality of pixels PX connected to the lines. According to embodiments, each of the pixels PX may include at least two transistors, at least one capacitor, and a light emitting element, and the display panel 110 may be a light emitting display panel. According to other embodiments, the display panel 110 may include a display panel of a quantum dot display device (QDD), a display panel of a liquid crystal display device (LCD), a display panel of a field emission display device (FED), a display panel of a plasma display device (PDP), or a display panel of an electrophoretic display device (EPD).

The controller 150 (e.g., a timing controller (T-CON)) may receive image data IMG and an input control signal CON from an external host processor (e.g., an application processor (AP)), a graphic processing unit (GPU), or a graphic card. The image data IMG may be RGB image data including red image data, green image data, and blue image data. The control signal CON may include a vertical synchronization signal, a horizontal synchronization signal, an input data enable signal, a master clock signal, and the like, but embodiments are not limited thereto.

The controller 150 may convert the image data IMG into input image data IDATA by applying an algorithm (e.g., dynamic capacitance compensation (DCC), etc.) for correcting image quality to the image data IMG supplied from the external host processor. In some embodiments, when the controller 150 does not include an algorithm for improving image quality, the image data IMG may be output as the input image data IDATA. The controller 150 may supply the input image data IDATA to the luminance compensator 200 and the data driver 120.

The controller 150 may generate a data control signal CTLD for controlling driving of the input image data IDATA, a scan control signal CTLS, and an emission control signal CTLE based on the input control signal CON. For example, the scan control signal CTLS may include a vertical start signal, scan clock signals, and the like, and the data control signal CTLD may include a horizontal start signal, a data clock signal, and the like.

The scan driver 140 may generate scan signals SS based on the scan control signal CTLS received from the controller 150. The scan driver 140 may output the scan signals SS to the pixels PX connected to the scan lines SL. In addition, the scan driver 140 may additionally generate a gate initialization signal GI and a diode initialization signal GB to output the generated gate initialization signal GI and the generated diode initialization signal GB to the pixels PX.

The emission driver 180 may generate emission signals EM based on the emission control signal CTLE received from the controller 150. The emission driver 180 may output the emission signals EM to the pixels PX connected to the emission lines EML.

The power supply unit 160 may generate an initialization voltage VINT, a first power supply voltage ELVDD, and a second power supply voltage ELVSS, and may provide the initialization voltage VINT, the first power supply voltage ELVDD, and the second power supply voltage ELVSS to the pixels PX through the initialization voltage line VINTL, the first power supply voltage line ELVDDL, and the second power supply voltage line ELVSSL.

The current sensor 230 may be connected to the luminance compensator 200, and may sense a block current D3 and a sensing current IS through the first power supply voltage line ELVDDL or the second power supply voltage line ELVSSL to provide the sensed block current D3 and the sensed sensing current IS to the luminance compensator 200.

The temperature sensor 310 may be connected to the luminance compensator 200, and may provide a panel temperature ST obtained by measuring a temperature of the display panel 110 to the luminance compensator 200.

The luminance compensator 200 may generate a scaling factor SF for controlling a voltage level of a data voltage of the data driver 120 based on the input image data IDATA received from the controller 150. The luminance compensator 200 may divide the display panel 110 into a plurality of blocks based on coordinate information. For example, the luminance compensator 200 may divide the display panel 110 into 100 blocks based on the coordinate information. The luminance compensator 200 may sequentially display a preset reference image on the blocks when the display device 100 is powered on or powered off, and may sense a block current from each of the blocks through the current sensor 230. In this case, the reference image may be an image corresponding to reference image data RDATA output from the luminance compensator 200. When the reference image is displayed on each of the blocks, each of the blocks may have a greatest load. For example, the reference image may be a white image (e.g., 255 grayscale level). In other words, the luminance compensator 200 may sense the current flowing through each of the blocks through the current sensor 230 when each of the blocks has the greatest load (e.g., maximum load). In this case, even when the blocks have the same load (e.g., maximum load), the block current sensed by the current sensor 230 may vary according to characteristics and deterioration degrees of the pixels included in each of the blocks. The luminance compensator 200 may calculate a block reference current of each of the blocks by calculating the sensed block current for a preset time (e.g., a preset period). For example, the luminance compensator 200 may sense a block current of a first block for 60 seconds, and calculate and store an average value of sensed block currents as a block reference current of the first block. The luminance compensator 200 may receive the input image data IDATA when the display device 100 is driven, calculate a total load of the input image data IDATA, and calculate a block load of each of the blocks based on the total load of the input image data IDATA. The luminance compensator 200 may calculate a target current based on the block reference current and the block load.

For example, the luminance compensator 200 may calculate the target current by multiplying a ratio of the block load to the maximum load by the block reference current. The luminance compensator 200 may sense the current of each of the blocks (i.e., the sensing current) through the current sensor 230 when an input image corresponding to the input image data IDATA is displayed on each of the blocks of the display panel 110. The luminance compensator 200 may calculate the scaling factor SF for controlling the voltage level of the data voltage based on the target current, a black image current, and the sensing current. For example, the scaling factor SF may be defined as a difference between the sensing current and a sum of the target current and the black image current. In some embodiments, a value obtained by multiplying the ratio of the block load to the maximum load by the block reference current may be defined as an input current, a current value obtained by summing up the input current and the black image current may be defined as a target current, and a difference between the target current and the sensing current may be defined as a scaling factor SF.

In this case, the black image current may correspond to a current value measured when the display panel 110 has a black image. When the target current is generated, the black image current has to be reflected to generate an accurate target current. The black image current may be an initial black image current (e.g., a black image current BC of FIG. 3) stored in a memory (e.g., a memory 250 of FIG. 3) included in the luminance compensator 200 when the display device 100 is manufactured.

In addition, the black image current may vary in real time because of a variation of a threshold voltage of a driving transistor, a variation of a capacitance of a capacitor, generation of a leakage current in the display panel 110, a temperature variation caused by heat generation of the pixel or the line, deterioration of the pixel, and the like. For example, while the black image current does not have a significant influence at a high grayscale level, when the display panel 110 is driven with a low grayscale level (e.g., a 16 grayscale level or less), the black image current may have a relatively great influence. In this case, the scaling factor SF may be excessively corrected so that a luminance non-uniformity phenomenon in which an image luminance of the display panel 110 is relatively increased or relatively decreased may occur. According to the embodiments, the luminance compensator 200 may measure the black image current in real time to store the measured black image current in the memory, and calculate a sub-scaling factor SF' by using the measured black image current (e.g., a sub-black image current BC' of FIG. 3). In some embodiments, the luminance compensator 200 may be included in the controller 150, or may be configured outside the controller 150 as a single component. Hereinafter, the luminance compensator 200 will be described in detail with reference to FIGS. 3 to 8.

The data driver 120 may generate an analog data voltage based on the input image data IDATA received from the controller 150 and the scaling factor SF (or the sub-scaling factor SF') received from the luminance compensator 200. The data driver 120 may generate the data voltage corresponding to the input image data IDATA, and adjust the voltage level of the data voltage based on the scaling factor SF (or the sub-scaling factor SF') supplied from the luminance compensator 200. In this case, the data voltage having the voltage level that is adjusted will be defined as a data voltage VDATA (or a sub-data voltage VDATA'). The data driver 120 may output data voltages VDATA (or sub-data voltages VDATA') to the pixels PX connected to the data lines DL based on the data control signal CTLD. According to other embodiments, the data driver 120 and the controller 150 may be implemented as a single integrated circuit, and such an integrated circuit may be referred to as a timing controller-embedded data driver (TED).

As described above, since the display device 100 according to embodiments is configured such that the display panel 110 is divided into the blocks, the target current is calculated based on the block current and the block load of each of the blocks, and the scaling factor SF for controlling the voltage level of the data voltage is calculated based on the sensing current, the black image current, and the target current of each of the blocks, a difference between luminances of the blocks may be reduced. Therefore, uniformity of an image of the display device 100 may be improved.

In addition, since the luminance compensator 200 includes the black image current measured in real time, even when the black image current varies, the sub-scaling factor SF' may be prevented from being excessively corrected, especially at the low grayscale level. Accordingly, the luminance compensator 200 may generate a sub-target current that is relatively accurate even at the low grayscale level, and the data driver 120 may provide a sub-data voltage VDATA' that is accurate to the pixel PX based on the sub-target current and the sensing current.

However, although a data compensation scheme according to the embodiments has been described as using a block compensation (or local compensation) scheme, the configuration of the embodiments is not limited thereto. For example, according to other embodiments, data may be compensated for by using a global data compensation scheme (e.g., global current management (GCM)) or the like. In this case, the luminance compensator 200 may determine the target current by adding the input current input to the display panel 110 to the black image current measured in real time, and calculate the scaling factor SF based on the target current and the sensing current.

Figure 2:
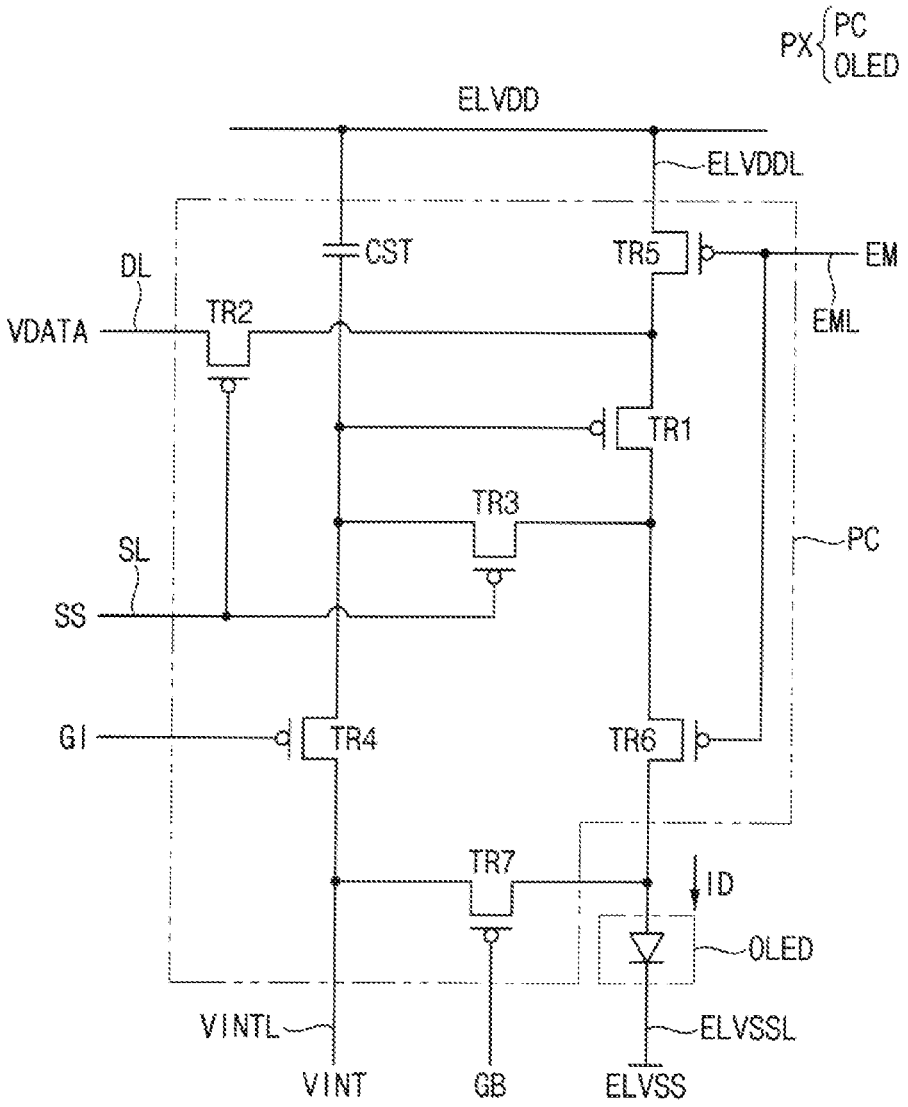
FIG. 2 is a circuit diagram of a representative pixel included in the display device of FIG. 1.

FIG. 2 is a circuit diagram showing a pixel included in the display device of FIG. 1.

Referring to FIG. 2, the display device 100 may include a pixel PX, and the pixel PX may include a pixel circuit PC and an organic light emitting diode OLED. In this case, the pixel circuit PC may include first to seventh transistors TR1, TR2, TR3, TR4, TR5, TR6, and TR7, a storage capacitor CST, and the like. In addition, the pixel circuit PC or the organic light emitting diode OLED may be connected to the first power supply voltage line ELVDDL, the second power supply voltage line ELVSSL, the initialization voltage line VINTL, the data line DL, the scan line SL, the emission line EML, and the like. The first transistor TR1 may correspond to a driving transistor, and the second to seventh transistors TR2, TR3, TR4, TR5, TR6, and TR7 may correspond to switching transistors. Each of the first to seventh transistors TR1, TR2, TR3, TR4, TR5, TR6, and TR7 may include a first terminal, a second terminal, and a gate terminal. According to the embodiments, the first terminal may be a source terminal, and the second terminal may be a drain terminal. In some embodiments, the first terminal may be a drain terminal, and the second terminal may be a source terminal.

The organic light emitting diode OLED may output a light based on a driving current ID. The organic light emitting diode OLED may include a first terminal and a second terminal. According to the embodiments, the second terminal of the organic light emitting diode OLED may receive the second power supply voltage ELVSS, and the first terminal of the organic light emitting diode OLED may receive the first power supply voltage ELVDD. For example, the first terminal of the organic light emitting diode OLED may be an anode terminal, and the second terminal of the organic light emitting diode OLED may be a cathode terminal. In some embodiments, the first terminal of the organic light emitting diode OLED may be a cathode terminal, and the second terminal of the organic light emitting diode OLED may be an anode terminal.

The first transistor TR1 may generate the driving current ID according to the data voltage VDATA (or the sub-data voltage VDATA'). According to the embodiments, the first transistor TR1 may operate in a saturation region. In this case, the first transistor TR1 may generate the driving current ID based on a voltage difference between the gate terminal and the source terminal of the first transistor TR1. In addition, grayscale levels may be expressed based on an amount of the driving current ID supplied to the organic light emitting diode OLED. In some embodiments, the first transistor TR1 may operate in a linear region. In this case, the grayscale levels may be expressed based on the sum of a time during which the driving current is supplied to the organic light emitting diode OLED within one frame.

The gate terminal of the second transistor TR2 may receive the scan signal SS. In this case, the scan signal SS may be provided from the scan driver 140. The first terminal of the second transistor TR2 may receive the data voltage VDATA. In this case, the data voltage VDATA may be provided from the data driver 120, and may correspond to a data voltage obtained by applying the scaling factor SF to the input image data IDATA. The second terminal of the second transistor TR2 may be connected to the first terminal of the first transistor TR1. The second transistor TR2 may supply the data voltage VDATA to the first terminal of the first transistor TR1 during an activation period of the scan signal SS. In this case, the second transistor TR2 may operate in a linear region.

The gate terminal of the third transistor TR3 may receive the scan signal SS. The first terminal of the third transistor TR3 may be connected to the gate terminal of the first transistor TR1. The second terminal of the third transistor TR3 may be connected to the second terminal of the first transistor TR1. The third transistor TR3 may connect the gate terminal of the first transistor TR1 to the second terminal of the first transistor TR1 during the activation period of the scan signal SS.

The gate terminal of the fourth transistor TR4 may receive the gate initialization signal GI. The first terminal of the fourth transistor TR4 may receive the initialization voltage VINT. The second terminal of the fourth transistor TR4 may be connected to the gate terminal of the first transistor TR1. The fourth transistor TR4 may supply the initialization voltage VINT to the gate terminal of the first transistor TR1 during an activation period of the gate initialization signal GI. In this case, the fourth transistor TR4 may operate in a linear region. In other words, the fourth transistor TR4 may initialize the gate terminal of the first transistor TR1 to the initialization voltage VINT during the activation period of the gate initialization signal GI. According to the embodiments, the initialization voltage VINT may have a voltage level that is sufficiently lower than a voltage level of the data voltage VDATA maintained by the storage capacitor CST in a previous frame, and the initialization voltage VINT may be supplied to the gate terminal of the first transistor TR1. According to other embodiments, the initialization voltage may have a voltage level that is sufficiently higher than the voltage level of the data voltage maintained by the storage capacitor in the previous frame, and the initialization voltage may be supplied to the gate terminal of the first transistor. According to the embodiments, the gate initialization signal GI may be substantially the same as a scan signal SS of one horizontal time before.

The gate terminal of the fifth transistor TR5 may receive the emission signal EM. In this case, the emission signal EM may be provided from the emission driver 180. The first terminal of the fifth transistor TR5 may receive the first power supply voltage ELVDD. The second terminal of the fifth transistor TR5 may be connected to the first terminal of the first transistor TR1. The fifth transistor TR5 may supply the first power supply voltage ELVDD to the first terminal of the first transistor TR1 during an activation period of the emission signal EM. On the contrary, the fifth transistor TR5 may cut off the supply of the first power supply voltage ELVDD during an inactivation period of the emission signal EM. In this case, the fifth transistor TR5 may operate in a linear region. Since the fifth transistor TR5 supplies the first power supply voltage ELVDD to the first terminal of the first transistor TR1 during the activation period of the emission signal EM, the first transistor TR1 may generate the driving current ID. In addition, since the fifth transistor TR5 cuts off the supply of the first power supply voltage ELVDD during the inactivation period of the emission signal EM, the data voltage VDATA supplied to the first terminal of the first transistor TR1 may be supplied to the gate terminal of the first transistor TR1.

The gate terminal of the sixth transistor TR6 may receive the emission signal EM. The first terminal of the sixth transistor TR6 may be connected to the second terminal of the first transistor TR1. The second terminal of the sixth transistor TR6 may be connected to the first terminal of the organic light emitting diode OLED. The sixth transistor TR6 may supply the driving current ID generated by the first transistor TR1 to the organic light emitting diode OLED during the activation period of the emission signal EM. In this case, the sixth transistor TR6 may operate in a linear region. In other words, since the sixth transistor TR6 supplies the driving current ID generated by the first transistor TR1 to the organic light emitting diode OLED during the activation period of the emission signal EM, the organic light emitting diode OLED may output the light. In addition, since the sixth transistor TR6 electrically separates the first transistor TR1 and the organic light emitting diode OLED from each other during the inactivation period of the emission signal EM, the gate terminal of the first transistor TR1 may have a compensated data voltage, which is generated based on the data voltage VDATA supplied to the second terminal of the first transistor TR1. For example, the compensated data voltage of the gate terminal of the first transistor TR1 may be reduced by the threshold voltage of the first transistor TR1 from the data voltage VDATA supplied to the second terminal of the first transistor TR1.

The gate terminal of the seventh transistor TR7 may receive the diode initialization signal GB. The first terminal of the seventh transistor TR7 may receive the initialization voltage VINT. The second terminal of the seventh transistor TR7 may be connected to the first terminal of the organic light emitting diode OLED. The seventh transistor TR7 may supply the initialization voltage VINT to the first terminal of the organic light emitting diode OLED during an activation period of the diode initialization signal GB. In this case, the seventh transistor TR7 may operate in a linear region. In other words, the seventh transistor TR7 may initialize the first terminal of the organic light emitting diode OLED to the initialization voltage VINT during the activation period of the diode initialization signal GB. In some embodiments, the gate initialization signal GI and the diode initialization signal GB may have substantially the same signal as each other.

The storage capacitor CST may include a first terminal and a second terminal. The storage capacitor CST may be connected between the first power supply voltage line ELVDDL and the gate terminal of the first transistor TR1. For example, the first terminal of the storage capacitor CST may be connected to the gate terminal of the first transistor TR1, and the second terminal of the storage capacitor CST may receive the first power supply voltage ELVDD. The storage capacitor CST may maintain a voltage level of the gate terminal of the first transistor TR1 during an inactivation period of the scan signal SS. The inactivation period of the scan signal SS may include the activation period of the emission signal EM, and the driving current ID generated by the first transistor TR1 may be supplied to the organic light emitting diode OLED during the activation period of the emission signal EM. Therefore, the driving current ID generated by the first transistor TR1 may be supplied to the organic light emitting diode OLED based on the voltage level maintained by the storage capacitor CST.

However, although the pixel circuit PC according to the embodiments has been described as including seven transistors and one storage capacitor, the configuration of the embodiments is not limited thereto. For example, the pixel circuit PC may have a configuration including at least one transistor and at least one storage capacitor.

In addition, although the light emitting element included in the pixel PX according to the embodiments has been described as including the organic light emitting diode OLED, the configuration of the embodiments is not limited thereto. For example, the light emitting element may include a quantum dot (QD) light emitting element, an inorganic light emitting diode, and the like.

Figure 3:
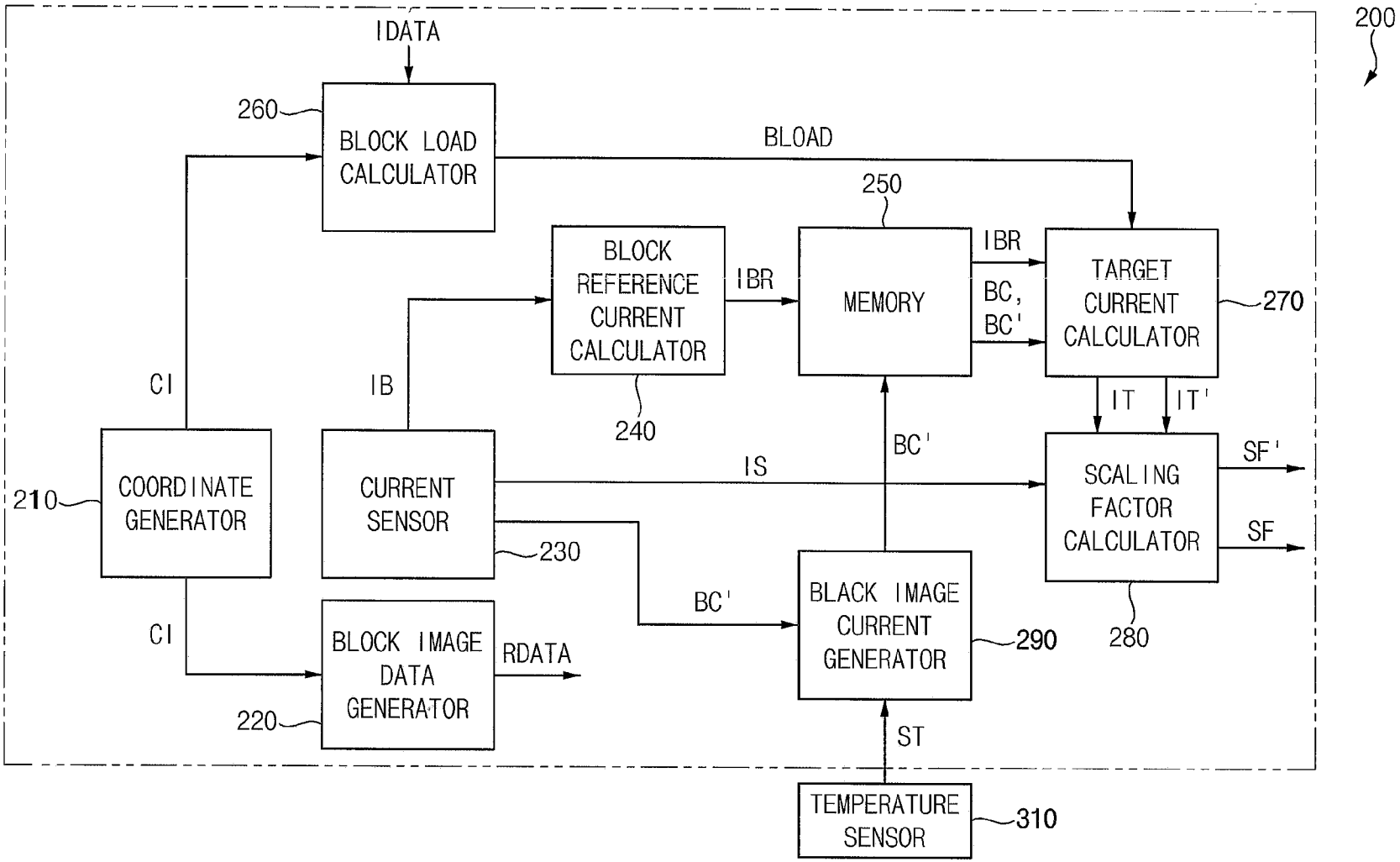
FIG. 3 is a block diagram of a luminance compensator included in the display device of FIG. 1.
Figure 4:
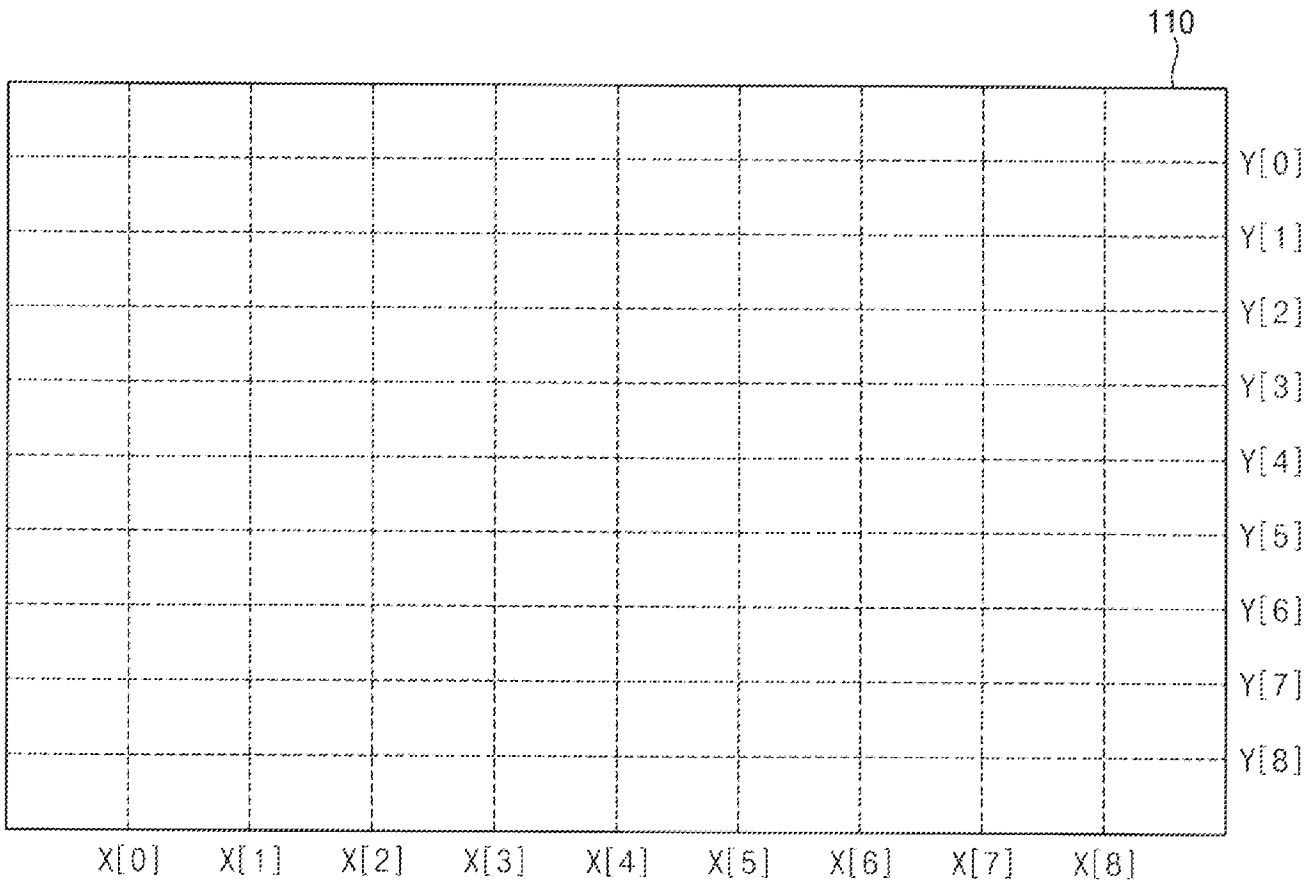
FIG. 4 is a diagram for describing an operation of a coordinate generator included in the luminance compensator of FIG. 3.

FIG. 3 is a block diagram showing a luminance compensator included in the display device of FIG. 1, and FIG. 4 is a diagram for describing an operation of a coordinate generator included in the luminance compensator of FIG. 3.

Referring to FIGS. 1, 3, and 4, the luminance compensator 200 may include a coordinate generator 210, a block image data generator 220, a current sensor 230, a block reference current calculator 240, a memory 250, a black image current generator 290, a block load calculator 260, a target current calculator 270, and a scaling factor calculator 280. In some embodiments, the current sensor 230 may be included in the luminance compensator 200. Alternatively, the current sensor 230 may be configured outside the luminance compensator 200 as a single component.

The coordinate generator 210 may generate coordinate information CI for dividing the display panel 110 into the plurality of blocks. The coordinate generator 210 may generate coordinate information CI for (m-1) x-axis coordinates and (n-1) y-axis coordinates, and divide the display panel 110 into m×n blocks (where each of m and n is a natural number that is greater than 2). For example, as shown in FIG. 4, the coordinate generator 210 may generate coordinate information CI for nine x-axis coordinates and nine y-axis coordinates, and divide the display panel 110 into 10×10 blocks, i.e., 100 blocks. The blocks may have the same size in an x-axis direction, and have the same size in a y-axis direction. For example, when the display panel 110 having a resolution of 3840×2160 is divided into 10×10 blocks, each of the blocks may include 384 pixels in the x-axis direction, and include 216 pixels in the y-axis direction.

The block image data generator 220 may generate the reference image data RDATA supplied to the data driver 120 based on the coordinate information CI. The block image data generator 220 may generate the reference image data RDATA when the display device 100 is powered on or powered off. The block image data generator 220 may sequentially supply the reference image data RDATA, which is to be supplied to each of the blocks, to the data driver 120. When the reference image corresponding to the reference image data RDATA is displayed on the display panel 110, each of the blocks may have a greatest load (e.g., maximum load). For example, the reference image may be a white image.

The current sensor 230 may sense the block current D3 and the sensing current IS of each of the blocks. The current sensor 230 may sense the block current D3 when the display device 100 is powered on or powered off. When the reference image data RDATA generated by the block image data generator 220 is sequentially supplied to the data driver 120, the reference image may be sequentially displayed on each of the blocks of the display panel 110. The current sensor 230 may sense the block current D3 of the block on which the reference image is displayed. When the reference image is displayed on each of the blocks of the display panel 110, each of the blocks may have the maximum load. In other words, the current sensor 230 may sense the block current IB flowing through each of the blocks when each of the blocks has the greatest load (e.g., maximum load). In this case, even when the blocks have the same load (i.e., the maximum load), the block current D3 sensed by the current sensor 230 may vary according to characteristics and deterioration degrees of the pixels included in each of the blocks. The current sensor 230 may measure the block current D3 for a preset time. For example, when the display device 100 is driven at 120 Hz, and when the current sensor 230 measures the block current D3 of the block on which the reference image is displayed for 1 second, the current sensor 230 may measure the block current D3 of the block on which the reference image is displayed 120 times. For example, the current sensor 230 may sense the sensing current IS when the display device 100 is driven. When the display device 100 is driven, the input image corresponding to the input image data IDATA may be displayed on each of the blocks. The current sensor 230 may measure the sensing current IS flowing through each of the blocks when the input image corresponding to the input image data IDATA is displayed on each of the blocks.

The block reference current calculator 240 may calculate a block reference current IBR based on the block current D3 sensed by the current sensor 230. The block reference current calculator 240 may calculate an average value of block currents D3 measured for a preset time in one block as the block reference current IBR. For example, when the current sensor 230 measures the block current IB 120 times for a preset time, the block reference current calculator 240 may calculate an average value of 120 block currents D3 as the block reference current IBR.

The memory 250 may store the block reference current IBR supplied from the block reference current calculator 240. In addition, a black image current BC may be stored in the memory 250. The black image current BC may correspond to an initial black image current BC stored when the display device 100 is manufactured. Furthermore, the memory 250 may store the measured black image current BC' provided from the black image current generator 290. The measured black image current BC' will be described in detail below.

The black image current generator 290 may measure a black image current from the display panel 110 through the current sensor 230 under a preset condition, and the black image current may be defined as the measured black image current BC'. In other words, the black image current generator 290 may receive the measured black image current BC', and store the measured black image current BC' in the memory 250. The preset condition will be described in detail with reference to FIGS. 5 to 8. In addition, the black image current generator 290 may receive the panel temperature ST, which is obtained by measuring the temperature of the display panel 110, from the temperature sensor 310.

The block load calculator 260 may calculate a block load BLOAD of each of the blocks based on the coordinate information CI and the input image data IDATA. The block load calculator 260 may receive the coordinate information CI from the coordinate generator 210, and receive the input image data IDATA from the controller 150. The block load calculator 260 may calculate the total load of the input image data IDATA, and may calculate the block load BLOAD of each of the blocks based on the total load of the input image data IDATA.

The target current calculator 270 may calculate a target current IT of each of the blocks based on the block reference current IBR, the black image current BC (or the measured black image current BC'), and the block load BLOAD. The target current calculator 270 may receive the block reference current IBR and the black image current BC (or the measured black image current BC') stored in the memory 250, and receive the block load BLOAD from the block load calculator 260. Since the block reference current IBR is the current flowing through each of the blocks when each of the blocks has the maximum load, the target current calculator 270 may calculate the target current IT (or a sub-target current IT') based on a ratio of the block load BLOAD to the maximum load, the black image current BC (or the measured black image current BC'), and the block reference current IBR.

For example, when the black image current BC (e.g., the initial black image current) is 25 mA, the maximum load of one block among the blocks is 10, the block reference current IBR is 5 mA, and the block load BLOAD is 2, the target current calculator 270 may calculate the target current IT of 26 mA by adding the black image current BC of 25 mA to a multiplication result of 1 mA, which is obtained by multiplying the block reference current IBR of 5 mA by 0.2 (i.e., 2/10) as the ratio of the block load to the maximum load.

Similarly, when the measured black image current BC' is 20 mA, the maximum load of one block among the blocks is 10, the block reference current IBR is 5 mA, and the block load BLOAD is 2 (e.g., when the one block displays an image having a specific grayscale level), the target current calculator 270 may calculate the sub-target current IT' of 21 mA by adding the measured black image current BC' of 20 mA to a multiplication result of 1 mA, which is obtained by multiplying the block reference current IBR of 5 mA by 0.2 (i.e., 2/10) as the ratio of the block load to the maximum load.

The scaling factor calculator 280 may calculate the scaling factor SF (or the sub-scaling factor SF') based on the target current IT (or the sub-target current IT') and the sensing current IS. The scaling factor calculator 280 may receive the target current IT (or the sub-target current IT') of each of the blocks from the target current calculator 270, and receive the sensing current IS, which flows through each of the blocks when the input image corresponding to the input image data IDATA is displayed on the display panel 110, from the current sensor 230. The scaling factor calculator 280 may calculate the scaling factor SF (or the sub-scaling factor SF') by comparing the target current IT (or the sub-target current IT') with the sensing current IS. The scaling factor calculator 280 may output the scaling factor SF (or the sub-scaling factor SF') to the data driver 120.

For example, when the target current IT is 26 mA (or when the black image current BC as the initial black image current is 25 mA), and when the sensing current IS is 30 mA, the scaling factor SF may be 4 mA. In some embodiments, a value obtained by multiplying the ratio of the block load BLOAD to the maximum load by the block reference current IBR may be defined as an input current, a current value obtained by summing up the input current and the black image current BC may be defined as a target current IT, and a difference between the target current IT and the sensing current IS may be defined as a scaling factor SF.

Similarly, when the sub-target current IT' is 21 mA (or when the measured black image current BC' is 20 mA), and when the sensing current IS is 30 mA, the sub-scaling factor SF' may be 9 mA. In some embodiments, a value obtained by multiplying the ratio of the block load BLOAD to the maximum load by the block reference current IBR may be defined as an input current, a current value obtained by summing up the input current and the measured black image current BC' may be defined as a sub-target current IT', and a difference between the sub-target current IT' and the sensing current IS may be defined as a sub-scaling factor SF'.

According to other embodiments, in the global data compensation scheme, the luminance compensator 200 may determine the target current IT by adding the input current input to the display panel 110 to the black image current BC, and determine a current corresponding to the difference between the target current IT and the sensing current IS as the scaling factor SF. Thereafter, the data driver 120 may generate a data voltage corresponding to the input image data IDATA, and provide the data voltage VDATA, which is obtained by applying the scaling factor SF to the data voltage, to the pixel PX. In addition, the black image current BC may vary in real time because of the variation of the threshold voltage of the driving transistor, the variation of the capacitance of the capacitor, and the generation of the leakage current in the display panel 110, the temperature variation caused by the heat generation of the pixel or the like, the deterioration of the pixel, and the like. In this case, the black image current generator 290 may measure the black image current from the display panel 110 through the current sensor 230 under the preset condition, and the black image current may be defined as the measured black image current BC'. In other words, the black image current generator 290 may receive the measured black image current BC', and store the measured black image current BC' in the memory 250. Furthermore, the luminance compensator 200 may determine the sub-target current IT' by adding the input current input to the display panel 110 to the measured black image current BC', and determine a current corresponding to the difference between the sub-target current IT' and the sensing current IS as the sub-scaling factor SF'. Thereafter, the data driver 120 may generate a data voltage corresponding to the input image data IDATA, and provide the sub-data voltage VDATA', which is obtained by applying the sub-scaling factor SF' the data voltage, to the pixel PX.

According to a conventional display device, a luminance compensator may determine a target current based on an input current input to a display panel, and determine a current corresponding to a difference between the target current and a sensing current as a scaling factor. Thereafter, a data driver may generate a data voltage corresponding to input image data, and provide a data voltage, which is obtained by applying the scaling factor to the data voltage, to a pixel. In this case, since a black image current is not included in determining the target current, an accurate target current may not be generated.

Since the display device 100 according to the embodiments is configured such that the target current IT is determined by adding the input current input to the display panel 110 to the black image current BC, and the current corresponding to the difference between the target current IT and the sensing current IS is determined as the scaling factor SF, display quality of the display device 100 may be relatively improved.

In addition, since the luminance compensator 200 includes the measured black image current BC', even when the black image current BC varies, the sub-scaling factor SF' may be prevented from being excessively corrected, especially at the low grayscale level. Accordingly, the luminance compensator 200 may generate the sub-target current IT' that is relatively accurate even at the low grayscale level, and the data driver 120 may provide the sub-data voltage VDATA' that is accurate to the pixel PX based on the sub-target current IT' and the sensing current IS.

Figure 5:
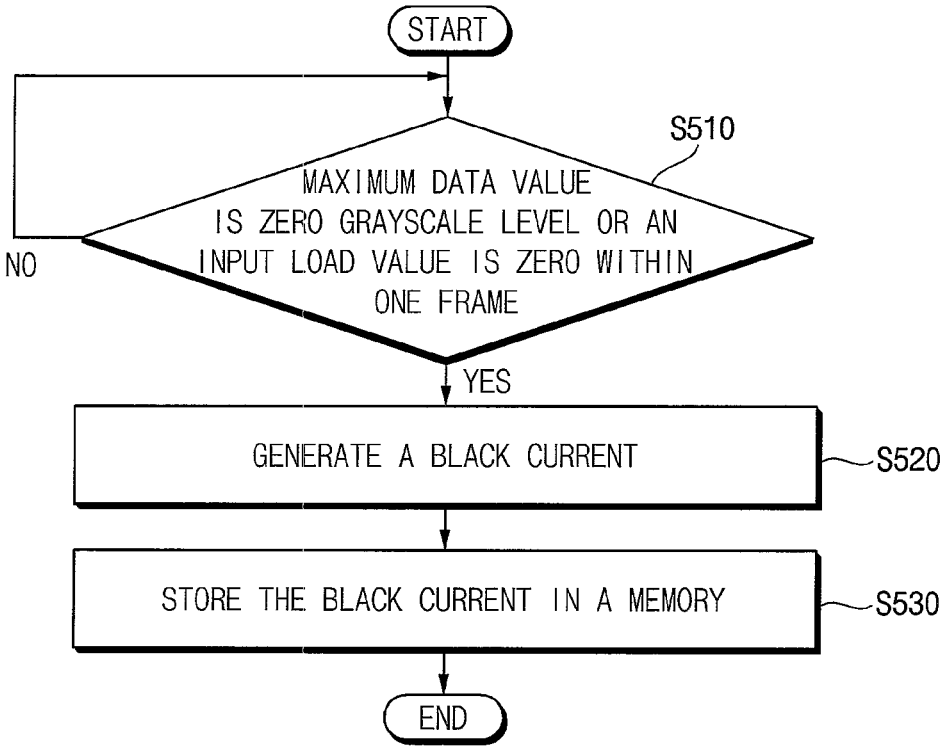
FIG. 5 is a flowchart for describing an embodiment of a method of operating a black image current generator included in the luminance compensator of FIG. 3 according to the principles of the invention.

FIG. 5 is a flowchart for describing a method of operating a black image current generator included in the luminance compensator of FIG. 3. For example, FIG. 5 is a flowchart for describing the preset condition described in FIG. 3.

Referring to FIGS. 3 and 5, a method of operating a black image current generator 290 may include: determining whether a maximum data value is 0 (e.g., zero grayscale level) or an input load value is 0 within one frame (S510); measuring (or generating) a black image current when the maximum data value is determined as 0 (e.g., zero grayscale level) or the input load value is determined as 0 (e.g., zero grayscale level) (S520); and storing the measured black image current in a memory of a luminance compensator (S530).

The black image current generator 290 may measure the black image current from a display panel 110 through a current sensor 230 under a preset condition. According to embodiments, the black image current generator 290 may determine whether the maximum data value is 0 (e.g., zero grayscale level) or the input load value is 0 within one frame, and measure (or generate) the black image current through the current sensor 230 when the maximum data value is determined as 0 (e.g., zero grayscale level) or the input load value is determined as 0 within one frame. In this case, the black image current may be defined as a measured black image current BC'. The measured black image current BC' may be stored in the memory 250. In other words, when a black image is displayed on the display panel 110, the measured black image current BC' may be measured through the current sensor 230.

Figure 6:
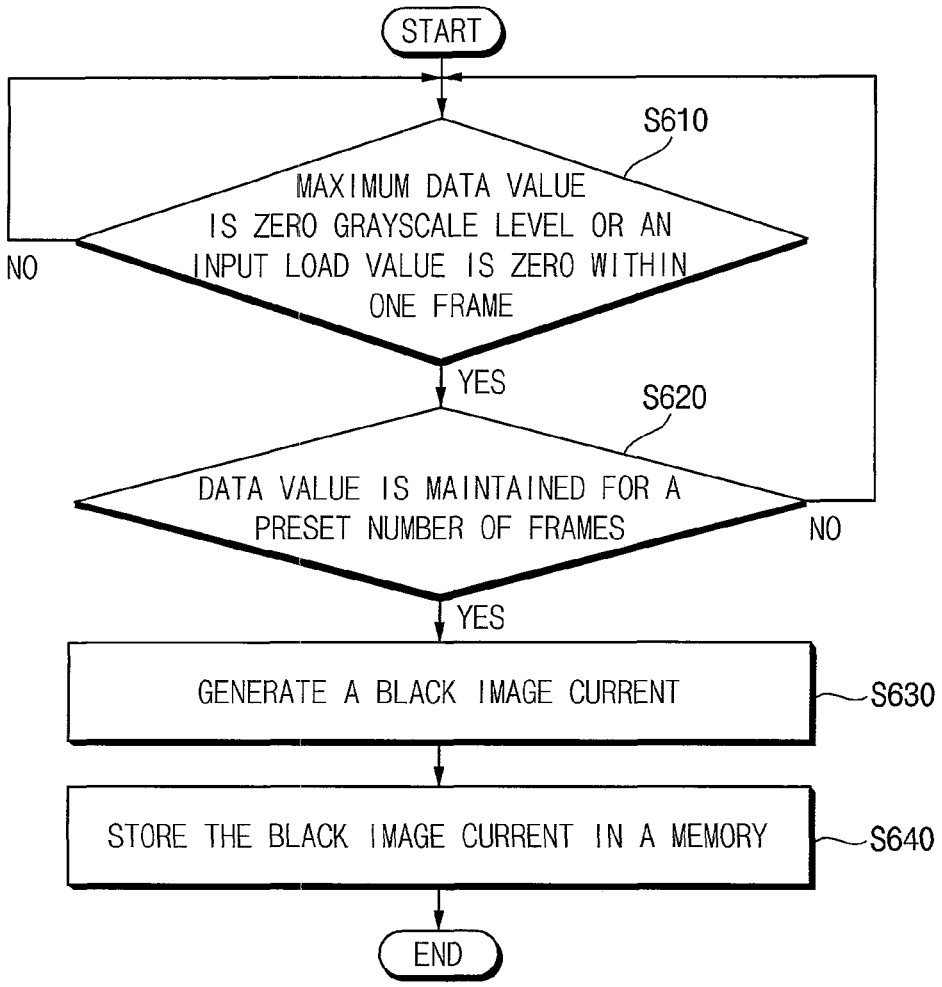
FIG. 6 is a flowchart for describing another embodiment of a method of operating a black image current generator included in the luminance compensator of FIG. 3.

FIG. 6 is a flowchart for describing one example of a method of operating a black image current generator included in the luminance compensator of FIG. 3. For example, FIG. 6 is a flowchart for describing the preset condition described in FIG. 3.

Referring to FIGS. 3 and 6, a method of operating a black image current generator 290 may include: determining whether a maximum data value is 0 (e.g., zero grayscale level) or an input load value is 0 within one frame (S610); determining whether the maximum data value is maintained to have zero grayscale level for a preset number of frames or more when the maximum data value is determined as 0 (e.g., zero grayscale level) or the input load value is determined as 0 (S620); measuring (or generating) a black image current when the maximum data value is determined as being maintained to have zero grayscale level for the preset number of frames or more (S630); and storing the measured black image current in a memory of a luminance compensator (S640).

The black image current generator 290 may measure the black image current from a display panel 110 through a current sensor 230 under a preset condition. According to embodiments, the black image current generator 290 may determine whether the maximum data value is 0 (e.g., zero grayscale level) or the input load value is 0 within one frame, and determine whether the maximum data value is maintained to have zero grayscale level for the preset number of frames or more when the maximum data value is determined as 0 (e.g., zero grayscale level) or the input load value is determined as 0 within one frame. The black image current generator 290 may determine whether the maximum data value is maintained to have zero grayscale level for the preset number of frames or more, and measure (or generate) the black image current through the current sensor 230 when the maximum data value is determined as being maintained to have zero grayscale level for the preset number of frames or more. In this case, the black image current may be defined as a measured black image current BC'. The measured black image current BC' may be stored in the memory 250. In other words, when a black image is displayed on the display panel 110, the measured black image current BC' may be measured through the current sensor 230.

For example, in a case of measuring the black image current when the black image is maintained for a relatively small number of frames (e.g., when the black image is maintained for the preset number of frames or less), reliability of the measured black image current may be relatively low. Accordingly, the black image current may be measured when the black image is maintained for a predetermined period (e.g., when maintained for the preset number of frames or more). In this case, the measured black image current BC' with relatively high reliability may be obtained.

Figure 7:
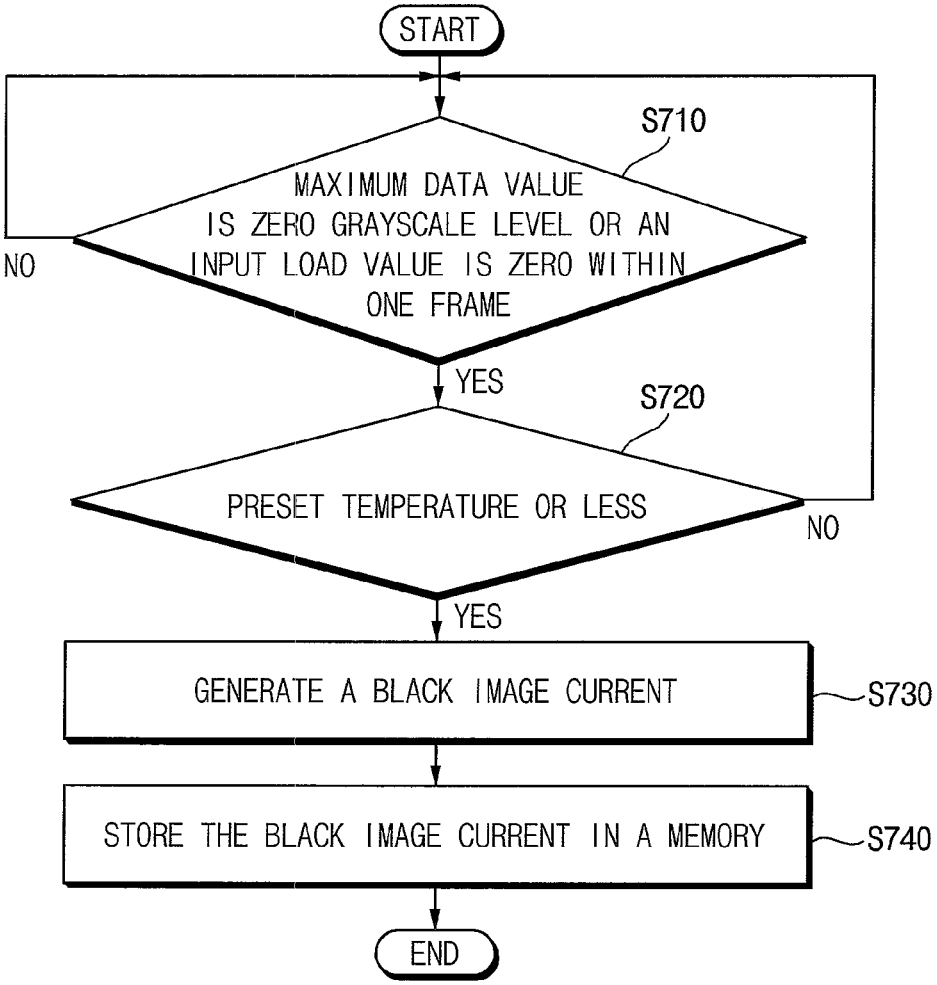
FIG. 7 is a flowchart for describing another embodiment of a method of operating a black image current generator included in the luminance compensator of FIG. 3.

FIG. 7 is a flowchart for describing another example of a method of operating a black image current generator included in the luminance compensator of FIG. 3. For example, FIG. 7 is a flowchart for describing the preset condition described in FIG. 3.

Referring to FIGS. 3 and 7, a method of operating a black image current generator 290 may include: determining whether a maximum data value is 0 (e.g., zero grayscale level) or an input load value is 0 within one frame (S710); determining whether a temperature measured from a display panel is less than or equal to a preset temperature when the maximum data value is determined as 0 (e.g., zero grayscale level) or the input load value is determined as 0 (S720); measuring (or generating) a black image current when the temperature measured from the display panel is determined as being less than or equal to the preset temperature (S730); and storing the measured black image current in a memory of a luminance compensator (S740).

The black image current generator 290 may measure the black image current from a display panel 110 through a current sensor 230 under a preset condition. According to embodiments, the black image current generator 290 may determine whether the maximum data value is 0 (e.g., zero grayscale level) or the input load value is 0 within one frame, and determine whether the temperature measured from the display panel is less than or equal to the preset temperature when the maximum data value is determined as 0 (e.g., zero grayscale level) or the input load value is determined as 0 within one frame. The black image current generator 290 may measure (or generate) the black image current through the current sensor 230 when the temperature measured from the display panel is determined as being less than or equal to the preset temperature. In this case, the black image current may be defined as a measured black image current BC'. The measured black image current BC' may be stored in the memory 250. In other words, when a black image is displayed on the display panel 110, the measured black image current BC' may be measured through the current sensor 230.

For example, in a case of measuring the black image current when the temperature of the display panel 110 is relatively high (e.g., greater than or equal to the preset temperature), reliability of the measured black image current may be relatively low. Accordingly, the black image current may be measured when the temperature of the display panel 110 is less than or equal to the preset temperature. In this case, the measured black image current BC' with relatively high reliability may be obtained.

Figure 8:
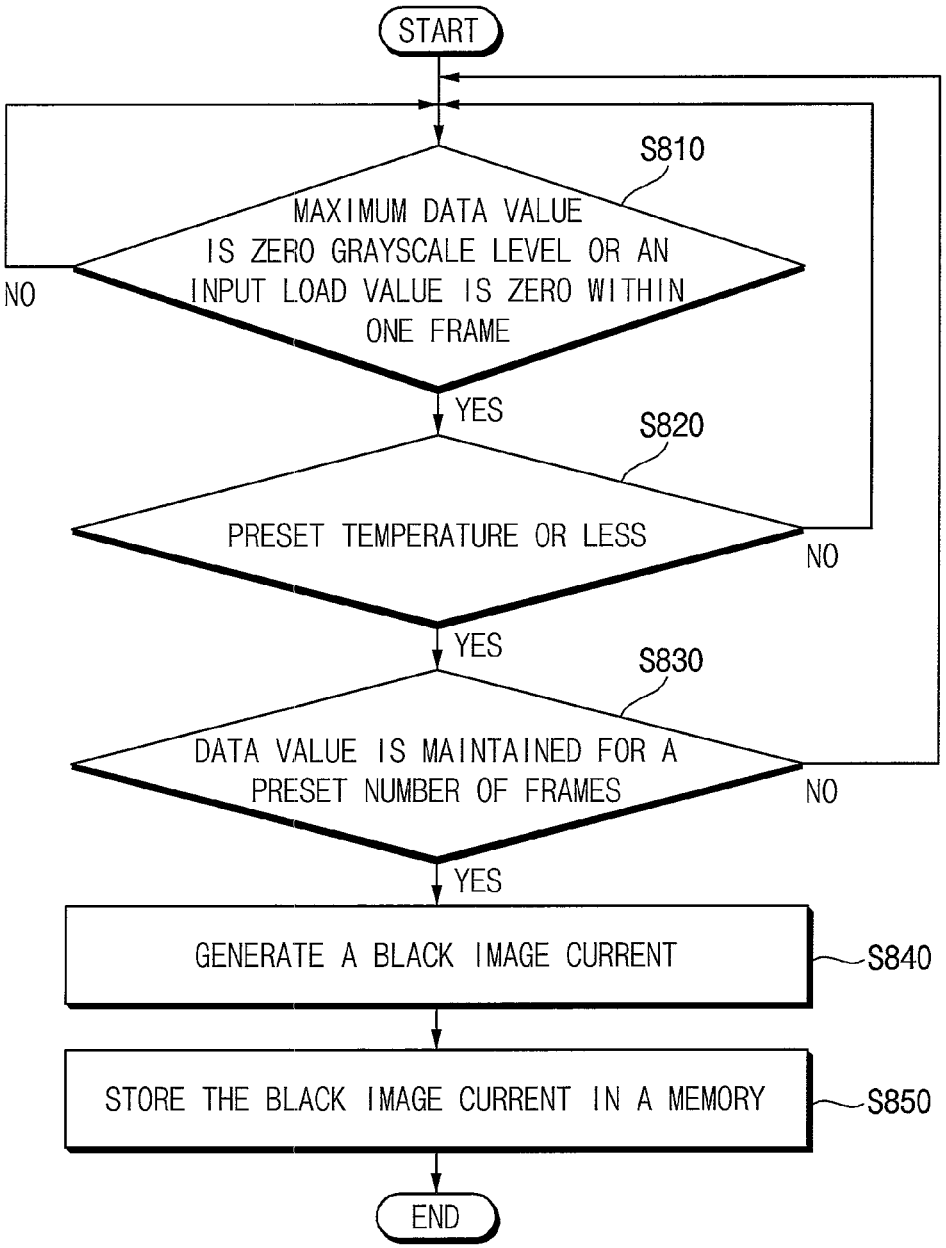
FIG. 8 is a flowchart for describing still another embodiment of a method of operating a black image current generator included in the luminance compensator of FIG. 3.

FIG. 8 is a flowchart for describing still another example of a method of operating a black image current generator included in the luminance compensator of FIG. 3. For example, FIG. 8 is a flowchart for describing the preset condition described in FIG. 3.

Referring to FIGS. 3 and 8, a method of operating a black image current generator 290 may include: determining whether a maximum data value is 0 (e.g., zero grayscale level) or an input load value is 0 within one frame (S810); determining whether a temperature measured from a display panel is less than or equal to a preset temperature when the maximum data value is determined as 0 (e.g., zero grayscale level) or the input load value is determined as 0 (S820); determining whether the maximum data value is maintained to have zero grayscale level for a preset number of frames or more when the temperature measured from the display panel is determined as being less than or equal to the preset temperature (S830); measuring (or generating) a black image current when the maximum data value is determined as being maintained to have zero grayscale level for the preset number of frames or more (S840); and storing the measured black image current in a memory of a luminance compensator (S850).

The black image current generator 290 may measure the black image current from a display panel 110 through a current sensor 230 under a preset condition. According to embodiments, the black image current generator 290 may determine whether the maximum data value is 0 (e.g., zero grayscale level) or the input load value is 0 within one frame, and determine whether the temperature measured from the display panel is less than or equal to the preset temperature when the maximum data value is determined as 0 (e.g., zero grayscale level) or the input load value is determined as 0 within one frame. The black image current generator 290 may determine whether the maximum data value is maintained to have zero grayscale level for the preset number of frames or more when the temperature measured from the display panel is determined as being less than or equal to the preset temperature. The black image current generator 290 may determine whether the maximum data value is maintained to have zero grayscale level for the preset number of frames or more, and may measure (or generate) the black image current through the current sensor 230 when the maximum data value is determined as being maintained to have zero grayscale level for the preset number of frames or more. In this case, the black image current may be defined as a measured black image current BC'. The measured black image current BC' may be stored in the memory 250. In other words, when a black image is displayed on the display panel 110, the measured black image current BC' may be measured through the current sensor 230.

For example, in a case of measuring the black image current when the temperature of the display panel 110 is relatively high (e.g., greater than or equal to the preset temperature), reliability of the measured black image current may be relatively low. In addition, in a case of measuring the black image current when the black image is maintained for a relatively small number of frames (e.g., when the black image is maintained for the preset number of frames or less), the reliability of the measured black image current may be relatively low. Accordingly, the black image current may be measured when the temperature of the display panel 110 is less than or equal to the preset temperature, and the black image is maintained for a predetermined period. In this case, the measured black image current BC' with relatively high reliability may be obtained.

According to other embodiments, an order of the determining of whether the temperature measured from the display panel is less than or equal to the preset temperature (S820) and the determining of whether the maximum data value is maintained to have zero grayscale level for the preset number of frames or more (S830) may be reversed and performed.

Figure 9:
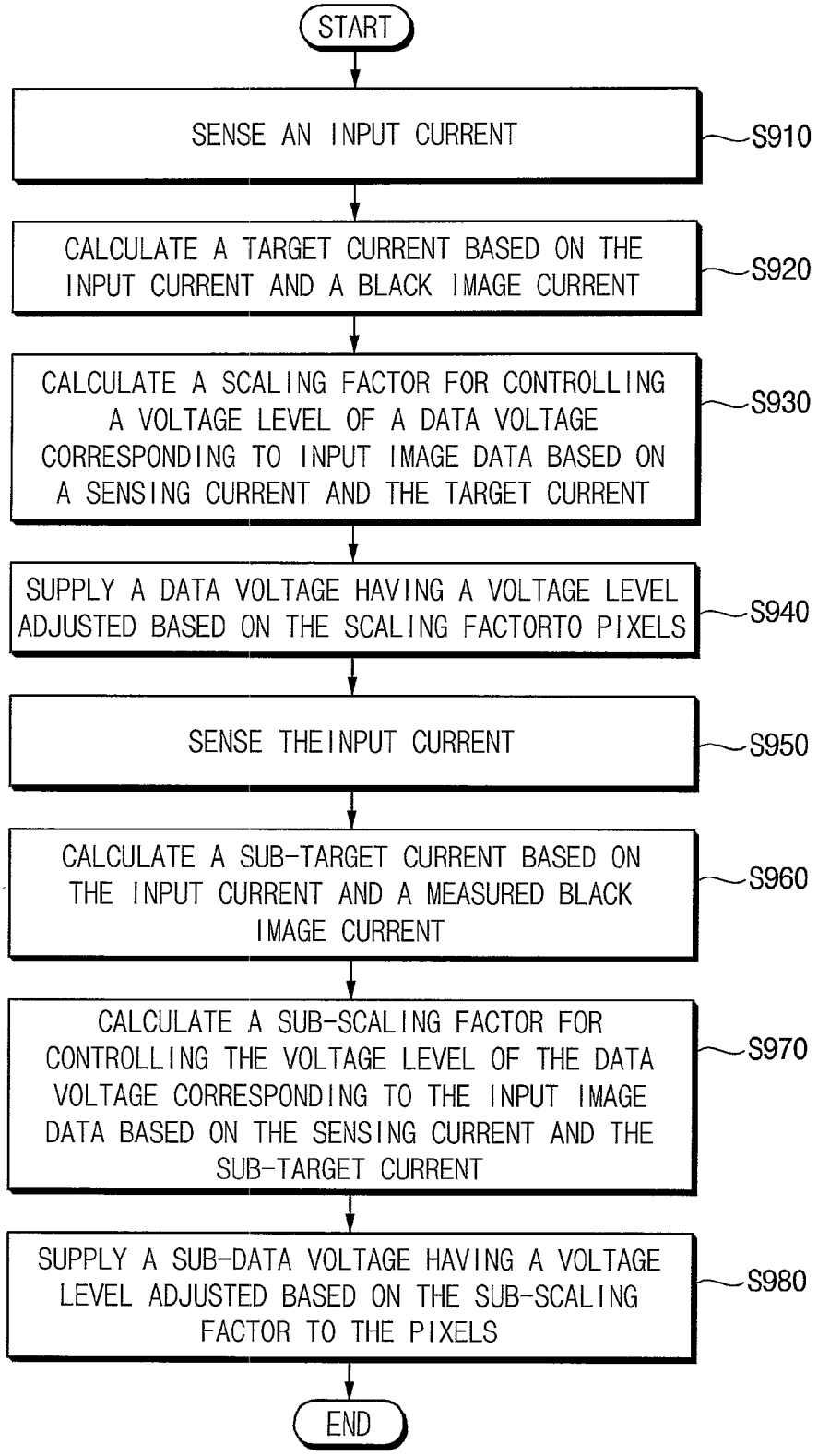
FIG. 9 is a flowchart illustrating an embodiment of a method of driving the display device of FIG. 1 according to the principles of the invention.

FIG. 9 is a flowchart showing a method of driving a display device.

Referring to FIGS. 1, 3, and 5 to 9, a method of driving a display device may include: sensing an input current input to a display panel (S910); calculating a target current based on the input current and a black image current (S920); measuring a sensing current from the display panel, and calculating a scaling factor for controlling a voltage level of a data voltage corresponding to input image data based on the sensing current and the target current (S930); supplying a data voltage, which has a voltage level adjusted based on the scaling factor, to pixels (S940); sensing the input current input to the display panel (S950); calculating a sub-target current based on the input current and a measured black image current (S960); measuring the sensing current from the display panel, and calculating a sub-scaling factor for controlling the voltage level of the data voltage corresponding to the input image data based on the sensing current and the sub-target current (S970); and supplying a sub-data voltage, which has a voltage level adjusted based on the sub-scaling factor, to the pixels (S980).

According to embodiments, one of the methods of operating the black image current generator 290 described with reference to FIGS. 5 to 8 may be performed before the calculating of the sub-target current based on the input current and the measured black image current (S960) (or before the sensing of the input current input to the display panel (S950)).

A luminance compensator 200 may sense an input current input to a display panel 110. The luminance compensator 200 may determine (or calculate) a target current IT by adding the input current input to the display panel 110 to a black image current BC. A scaling factor SF for controlling a voltage level of a data voltage corresponding to input image data IDATA may be calculated based on a sensing current IS and the target current IT. In other words, a current corresponding to a difference between the target current IT and the sensing current IS may be determined as the scaling factor SF. A data voltage VDATA having a voltage level adjusted based on the scaling factor SF may be provided to a pixel PX. In other words, the data voltage VDATA obtained by applying the scaling factor SF to the data voltage may be provided to the pixel PX.

The black image current generator 290 may measure the black image current from the display panel 110 through a current sensor 230 under a preset condition. In this case, the black image current may be defined as a measured black image current BC'. The luminance compensator 200 may sense the input current input to the display panel 110. The luminance compensator 200 may determine (or calculate) a sub-target current IT' by adding the input current input to the display panel 110 to the measured black image current BC'. A sub-scaling factor SF' for controlling the voltage level of the data voltage corresponding to the input image data IDATA may be calculated based on the sensing current IS and the sub-target current IT'. In other words, a current corresponding to a difference between the sub-target current IT' and the sensing current IS may be determined as the sub-scaling factor SF'. A sub-data voltage VDATA' having a voltage level adjusted based on the sub-scaling factor SF' may be provided to the pixel PX. In other words, the sub-data voltage VDATA' obtained by applying the sub-scaling factor SF' to the data voltage may be provided to the pixel PX.

According to other embodiments, a method of driving a display device may include: sensing an input current input to a display panel (S910); calculating a target current based on the input current and a black image current (S920); measuring a sensing current from the display panel, and calculating a scaling factor for controlling a voltage level of a data voltage corresponding to input image data based on the sensing current and the target current (S930); and supplying a data voltage, which has a voltage level adjusted based on the scaling factor, to pixels (S940).

In addition, together with the method of operating the black image current generator 290, the method of driving the display device may include: sensing the input current input to the display panel (S950); calculating a sub-target current based on the input current and a measured black image current (S960); measuring the sensing current from the display panel, and calculating a sub-scaling factor for controlling the voltage level of the data voltage corresponding to the input image data based on the sensing current and the sub-target current (S970); and supplying a sub-data voltage, which has a voltage level adjusted based on the sub-scaling factor, to the pixels (S980), and the driving method may be repeatedly performed.

Since the method of driving the display device according to embodiments is configured such that the target current IT is determined by adding the input current input to the display panel 110 to the black image current BC, and the current corresponding to the difference between the target current IT and the sensing current IS is determined as the scaling factor SF, display quality of the display device may be relatively improved.

In addition, since the luminance compensator 200 includes the measured black image current BC', even when the black image current BC varies, the sub-scaling factor SF' may be prevented from being excessively corrected, especially at a low grayscale level. Accordingly, the luminance compensator 200 may generate the sub-target current IT' that is relatively accurate even at the low grayscale level, and the data driver 120 may provide the sub-data voltage VDATA' that is accurate to the pixel PX based on the sub-target current IT' and the sensing current IS.

Furthermore, since the method of operating the black image current generator 290 is used, the measured black image current BC' with relatively high reliability may be obtained.

Figure 10:
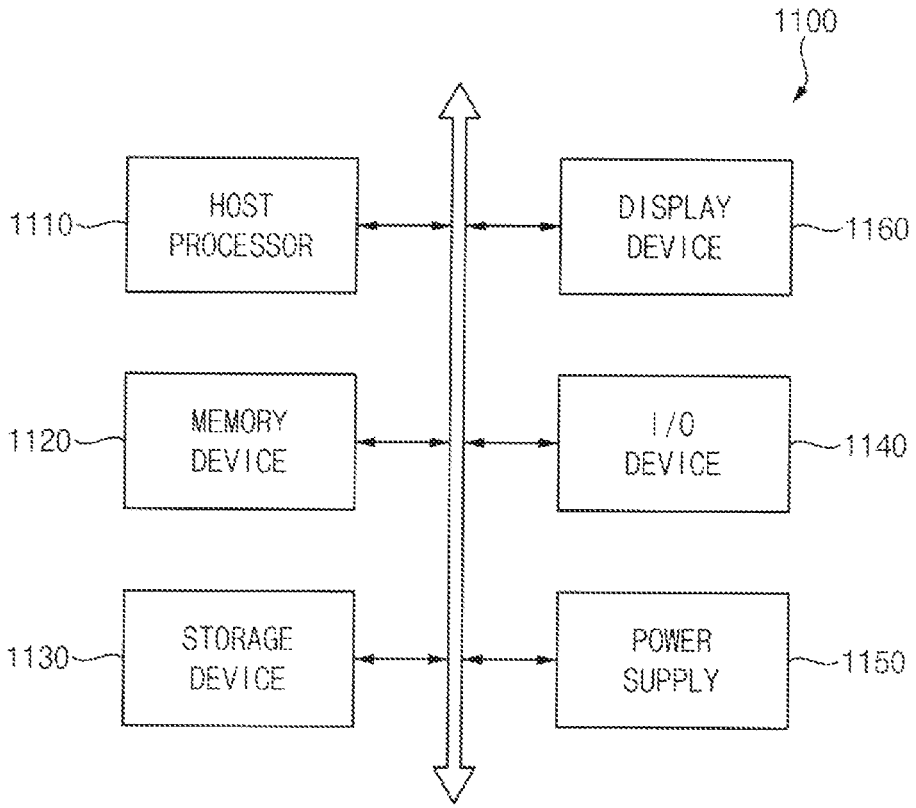
FIG. 10 is a block diagram of an embodiment of an electronic device including the display device of FIG. 1 constructed according to the principles of the invention.

FIG. 10 is a block diagram illustrating an electronic device including a display device according to an embodiment.

Referring to FIG. 11, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAIVI) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

The display device 1160 may include a display panel including a plurality of pixels, a controller, a data driver, a scan driver, an emission driver, a power supply unit, a luminance compensator, a current sensor, a temperature sensor, and the like. Here, the luminance compensator may include a coordinate generator, a block image data generator, a current sensor, a block reference current calculator, a memory, a black image current generator, a block load calculator, a target current calculator, and a scaling factor calculator. Since the display device 1160 is configured such that the target current is determined by adding the input current input to the display panel to the black image current, and the current corresponding to the difference between the target current and the sensing current is determined as the scaling factor, display quality of the display device 1610 may be relatively improved. In addition, since the luminance compensator includes the measured black image current, even when the black image current varies, the sub-scaling factor may be prevented from being excessively corrected, especially at the low grayscale level. Accordingly, the luminance compensator may generate the sub-target current that is relatively accurate even at the low grayscale level, and the data driver may provide the sub-data voltage that is accurate to the pixel based on the sub-target current and the sensing current.

The embodiments may be applied to any light emitting display device supporting the variable frame mode, and any electronic device 1100 including the light emitting display device. For example, the embodiments may be applied to a smart phone, a wearable electronic device, a tablet computer, a mobile phone, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The embodiments may be applied to various electronic devices including a display device. For example, the embodiments may be applied to numerous electronic devices such as vehicle-display devices, ship-display devices, aircraft-display devices, portable communication devices, exhibition display devices, information transfer display devices, medical-display devices, etc.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel comprising a plurality of pixels;

a luminance compensator configured to calculate a scaling factor based on a target current and a sensing current, the target current being calculated based on an input current input to the display panel and a black image current, the sensing current being measured from the display panel; and a data driver configured to generate a data voltage based on input image data to supply the data voltage to the pixels, the data voltage having a voltage level adjusted based on the scaling factor.

2. The display device of claim 1, wherein the luminance compensator comprises a black image current generator, a current sensor, and a memory, and the black image current generator is configured to measure the black image current from the display panel by the current sensor under a preset condition, and store the measured black image current in the memory.

3. The display device of claim 2, wherein the luminance compensator is configured to calculate a sub-scaling factor based on the measured black image current.

4. The display device of claim 3, wherein the data driver is configured to supply a sub-data voltage to the pixels, the sub-data voltage having a voltage level adjusted based on the sub-scaling factor.

5. The display device of claim 2, wherein the measured black image current is measured from the display panel when a black image is displayed on the display panel.

6. The display device of claim 2, wherein the black image current generator is configured to measure the black image current from the display panel by the current sensor when a maximum data value is zero grayscale level or an input load value is zero within one frame.

7. The display device of claim 2, wherein the black image current generator is configured to measure the black image current from the display panel by the current sensor when a maximum data value is zero grayscale level within one frame, and the maximum data value is maintained to have zero grayscale level for a preset number of frames or more.

8. The display device of claim 2, further comprising a temperature sensor connected to the black image current generator, and configured to measure a temperature of the display panel.

9. The display device of claim 8, wherein the black image current generator is configured to measure the black image current from the display panel by the current sensor when a maximum data value is zero grayscale level within one frame, the temperature measured from the display panel by the temperature sensor is less than or equal to a preset temperature, and the maximum data value is maintained to have zero grayscale level for a preset number of frames or more.

10. The display device of claim 1, further comprising:

a scan driver configured to generate a scan signal to supply the scan signal to the pixels; and a controller configured to generate the input image data to provide the input image data to the data driver.

11. A display device comprising:

a display panel comprising a plurality of pixels;

a luminance compensator comprising a black image current generator, a current sensor, and a memory, the luminance compensator configured to measure a black image current from the display panel by the current sensor under a preset condition by the black image current generator, store the measured black image current in the memory, and calculate a sub-scaling factor based on a target current and a sensing current, the target current being calculated based on an input current input to the display panel and the measured black image current, the sensing current being measured from the display panel; and a data driver configured to generate a sub-data voltage based on input image data to supply the sub-data voltage to the pixels, the sub-data voltage having a voltage level adjusted based on the sub-scaling factor.

12. The display device of claim 11, wherein the measured black image current is measured from the display panel when a black image is displayed on the display panel.

13. The display device of claim 11, wherein the black image current generator is configured to measure the black image current from the display panel by the current sensor when a maximum data value is zero grayscale level or an input load value is zero within one frame.

14. The display device of claim 11, wherein the black image current generator is configured to measure the black image current from the display panel by the current sensor when a maximum data value is zero grayscale level within one frame, and the maximum data value is maintained to have zero grayscale level for a preset number of frames or more.

15. The display device of claim 11, further comprising a temperature sensor connected to the black image current generator, and configured to measure a temperature of the display panel, wherein the black image current generator is configured to measure the black image current from the display panel by the current sensor when a maximum data value is zero grayscale level within one frame, the temperature measured from the display panel by the temperature sensor is less than or equal to a preset temperature, and the maximum data value is maintained to have zero grayscale level for a preset number of frames or more.

16. A method of driving a display device, the method comprising:

sensing an input current input to a display panel;

calculating a target current based on the input current and a black image current;

measuring a sensing current from the display panel;

calculating a scaling factor for controlling a voltage level of a data voltage corresponding to input image data based on the sensing current and the target current; and supplying a data voltage to pixels, the data voltage having a voltage level adjusted based on the scaling factor.

17. The method of claim 16, further comprising:

determining whether a maximum data value is zero grayscale level or an input load value is zero within one frame;

measuring the black image current when the maximum data value is determined as zero grayscale level or the input load value is determined as zero; and storing the measured black image current in a memory of a luminance compensator.

18. The method of claim 16, further comprising:

determining whether a maximum data value is maintained to have zero grayscale level for a preset number of frames or more;

measuring the black image current when the maximum data value is determined as being maintained to have zero grayscale level for the preset number of frames or more; and storing the measured black image current in a memory of a luminance compensator.

19. The method of claim 16, further comprising:

determining whether a temperature measured from the display panel is less than or equal to a preset temperature;

measuring the black image current when the temperature measured from the display panel is determined as being less than or equal to the preset temperature; and storing the measured black image current in a memory of a luminance compensator.

20. The method of claim 16, further comprising:

sensing the input current input to the display panel;

calculating a sub-target current based on the input current and the measured black image current;

measuring the sensing current from the display panel;

calculating a sub-scaling factor for controlling the voltage level of the data voltage corresponding to the input image data based on the sensing current and the sub-target current; and supplying a sub-data voltage to the pixels, the sub-data voltage having a voltage level adjusted based on the sub-scaling factor.

* * * * *